US011634297B2

(12) United States Patent
Harada et al.

(10) Patent No.: US 11,634,297 B2
(45) Date of Patent: Apr. 25, 2023

(54) MEDIA FOLDING DEVICE AND CONTROL METHOD FOR MEDIA FOLDING DEVICE

(71) Applicant: Seiko Epson Corporation, Tokyo (JP)

(72) Inventors: Yutaro Harada, Shiojiri (JP); Katsuyuki Kondo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/331,216

(22) Filed: May 26, 2021

(65) Prior Publication Data

US 2021/0276820 A1 Sep. 9, 2021

Related U.S. Application Data

(63) Continuation of application No. 16/656,300, filed on Oct. 17, 2019, now Pat. No. 11,046,549.

(30) Foreign Application Priority Data

Oct. 19, 2018 (JP) ..... JP2018-197311

(51) Int. Cl.

| | |
|---|---|
| ***B42C 1/12*** | (2006.01) |
| ***B65H 37/04*** | (2006.01) |
| *B42C 3/00* | (2006.01) |

(52) U.S. Cl.

CPC ..... *B65H 37/04* (2013.01); *B42C 1/12* (2013.01); *B42C 3/00* (2013.01); *B65H 2301/4505* (2013.01); *G03G 2215/00827* (2013.01); *G03G 2215/00877* (2013.01)

(58) Field of Classification Search

CPC ..... B42C 1/12; G03G 2215/00827; G03G 2215/00877; B65H 37/04; B65H 37/061; B65H 45/04; B65H 45/18; B65H 2301/4505

USPC ..... 270/32, 37, 45, 58.07, 58.08

See application file for complete search history.

(56) References Cited

U.S. PATENT DOCUMENTS

| | | | |
|---|---|---|---|
| 5,382,011 | A | 1/1995 | Tani |
| 7,121,993 | B2 | 10/2006 | Matsumoto |
| 7,954,797 | B2 | 6/2011 | Sasahara |

(Continued)

FOREIGN PATENT DOCUMENTS

| | | |
|---|---|---|
| JP | S61-248860 | 11/1986 |
| JP | 2006-069763 | 3/2006 |

(Continued)

*Primary Examiner* — Leslie A Nicholson, III

(74) *Attorney, Agent, or Firm* — Workman Nydegger

(57) ABSTRACT

A media folding device includes a stacking portion on which media transported from an introduction path are placed; a folding roller pair that folds the media at a folding position after the media have been stacked in the stacking portion; and a bend forming mechanism that includes a first abutting portion configured to abut against a front end of the media, which are stacked in the stacking portion, in a transport direction, and a second abutting portion that is configured to abut against a rear end of the media, which are stacked in the stacking portion, in the transport direction, and that causes the folding position of the media to be nipped by the folding roller pair the folding roller pair by shortening the relative distance between the first abutting portion and the second abutting portion to bend the media toward the folding roller pair.

11 Claims, 11 Drawing Sheets

(56) References Cited

U.S. PATENT DOCUMENTS

| | | | | |
|---|---|---|---|---|
| 8,439,340 | B2 * | 5/2013 | Maenishi | G03G 15/6541 270/32 |
| 2006/0049574 | A1 | 3/2006 | Matsumoto | |
| 2008/0185763 | A1 | 8/2008 | Iguchi | |
| 2012/0043713 | A1 | 2/2012 | Maenishi et al. | |
| 2012/0046154 | A1 | 2/2012 | Takeuchi et al. | |
| 2013/0193630 | A1 | 8/2013 | Ando et al. | |

FOREIGN PATENT DOCUMENTS

| | | |
|---|---|---|
| JP | 4108218 | 6/2008 |
| JP | 2012-041113 | 3/2012 |
| JP | 2012-041129 | 3/2012 |
| JP | 2012-082075 | 4/2012 |
| JP | 2012-111567 | 6/2012 |
| JP | 2012-140215 | 7/2012 |
| JP | 2013-173617 | 9/2013 |
| JP | 2018-020463 | 2/2018 |
| JP | 2020-049788 | 4/2020 |

* cited by examiner

MEDIA FOLDING DEVICE AND CONTROL METHOD FOR MEDIA FOLDING DEVICE

The present application is a continuation of U.S. application Ser. No. 16/656,300, filed Oct. 17, 2019, which is based on, and claims priority from, JP Application No. 2018-197311, filed Oct. 19, 2018, the disclosures of which are hereby incorporated by reference herein in their entirety.

BACKGROUND

1. Technical Field

The present disclosure relates to a media folding device that folds media and a control method for the media folding device.

2. Related Art

Some media processing devices that perform predetermined processing on media are, after performing saddle-stitch processing to bind the width-direction center of a plurality of stacked media, configured to be able to form a booklet by performing fold processing to fold the media at binding positions.

Further, such media processing devices may be incorporated into a recording system that is capable of continuously performing processing from recording on media by a recording device represented by an ink jet printer to saddle stitch processing and fold processing of the media after recording has been performed thereon.

Some such media processing devices are configured to include, for example, a folding roller pair and a blade for pushing media between the folding roller pair as a media folding device that performs folding processing, as illustrated in JP-A-2012-082075.

The media folding device described in JP-A-2012-082075, after the media have been pushed between the folding roller pair by the blade, pulls out only the blade from between the folding roller pair and performs fold processing in which the media are pressed and folded by rotation of the folding roller pair.

At this time, when the blade that has been pushed into the folding roller pair along with the media is pulled out, marks of the blade may be left as scratches on the media.

In addition, because the blade is sandwiched between the folding roller pair, the blade is formed in a comb-tooth shape that avoids the binding positions of the media; however, when the media are pushed in with such a comb-shaped blade, wrinkles may occur in the media.

SUMMARY

According to an aspect of the present disclosure, a media folding device includes a stacking portion on which media transported from an introduction path are placed; a folding roller pair that folds the media at a folding position after the media have been stacked in the stacking portion; and a bend forming mechanism that includes a first abutting portion configured to abut against a front end of the media, which are stacked in the stacking portion, in a transport direction, and a second abutting portion that is configured to abut against a rear end of the media, which are stacked in the stacking portion, in the transport direction, and that causes the folding position of the media to be nipped by the folding roller pair by shortening the relative distance between the first abutting portion and the second abutting portion to bend the media toward the folding roller pair.

DESCRIPTION OF EXEMPLARY EMBODIMENTS

Figure 1:
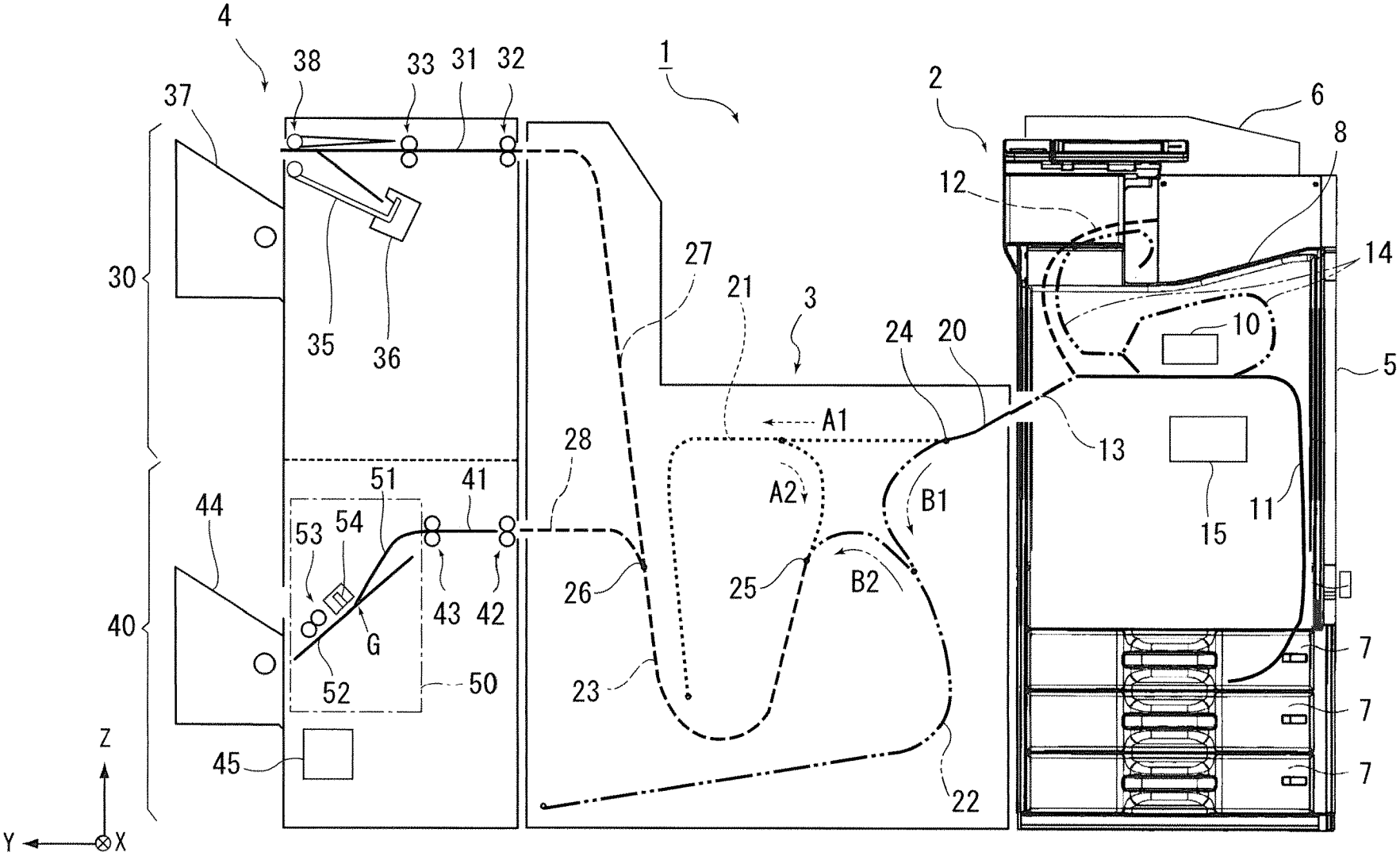
FIG. 1 is a schematic view of a recording system according to a first embodiment.

Hereinafter, the present disclosure will be schematically described.

A media folding device according to a first aspect includes a stacking portion on which media transported from an introduction path are placed; a folding roller pair that folds the media at a folding position after the media have been stacked in the stacking portion; and a bend forming mechanism that includes a first abutting portion configured to abut against a front end of the media, which are stacked in the stacking portion, in a transport direction, and a second abutting portion that is configured to abut against a rear end of the media, which are stacked in the stacking portion, in the transport direction, and that causes the folding position of the media to be nipped by the folding roller pair by shortening the relative distance between the first abutting portion and the second abutting portion to bend the media toward the folding roller pair.

According to this aspect, because the bend forming mechanism causes the folding position of the media to be nipped by the folding roller pair by shortening the relative distance between the first abutting portion and the second abutting portion to bend the media, it is possible to reduce the possibility of the surface of the media being scratched or wrinkled when the folding position of the media is folded by the folding roller pair.

In a second aspect according to the first aspect, the stacking portion is configured to allow bending of the media such that the folding position approaches the folding roller pair, and not allow bending of the media such that the folding position moves away from the folding roller pair.

According to this aspect, because the stacking portion is configured to allow bending of the media such that the folding position approaches the folding roller pair, and not allow bending of the media such that the folding position moves away from the folding roller pair, the media can be more reliably nipped by the folding roller pair through the bend forming mechanism.

In a third aspect according to the first aspect or the second aspect, the stacking portion includes a projecting portion that protrudes toward the folding roller pair at a position corresponding to the folding position when the media are bent.

According to this aspect, because the stacking portion includes a projecting portion that protrudes toward the folding roller pair at a position corresponding to the folding position when the media are bent, when the relative distance between the first abutting portion and the second abutting portion is shortened, the folding position can be easily bent toward the folding roller pair.

In a fourth aspect according to the first aspect to the third aspect, the stacking portion is formed by connecting an upstream member formed upstream in the transport direction and a downstream member formed downstream of the upstream member, and a connection portion between the upstream member and the downstream member is provided at a position corresponding to the folding position when the medium is bent and is configured to switch between a linear state in which the upstream member and the downstream member are flush and a bent state in which the upstream member and the downstream member are connected in a projecting shape toward the folding roller pair side.

According to this aspect, when the media are bent by the bend forming mechanism, the folding position can be easily bent so as to be directed to the folding roller pair side by putting the upstream member and the downstream member in the bent state. When the media are stacked in the stacking portion, the upstream member and the downstream member may be in the linear state to enable the media to be appropriately stacked.

In a fifth aspect according to the first aspect to the fourth aspect, the media folding device further includes an abutting member that is provided at a position on the opposite side to the folding roller pair with respect to the stacking portion, and that is configured to switch between a retracted state of being retracted from the stacking portion, and an advanced state of being advanced to the folding position of the media stacked in the stacking portion, in which the abutting member in the advanced state does not overlap the folding roller pair in an advancing direction.

According to this aspect, because the media folding device further includes an abutting member that is provided at a position on the opposite side to the folding roller pair with respect to the stacking portion, and that is configured to switch between a retracted state of being retracted from the stacking portion, and an advanced state of being advanced to the folding position of the media stacked in the stacking portion, in which the abutting member in the advanced state does not overlap the folding roller pair in an advancing direction, when shortening the relative distance between the first abutting portion and the second abutting portion, the folding position can be easily bent so as to be directed to the folding roller pair side by setting the abutting member in the advanced state.

In addition, because the abutting member in the advanced state does not overlap the folding roller pair in the advancing direction, when the abutting member is moved from the advanced state to the retracted state, it is possible to reduce the possibility of the abutting member scratching the medium.

In a sixth aspect according to the fifth aspect, the abutting member is configured to adjust an amount of advancement in the advancing state in accordance with the number of the media stacked in the stacking portion.

According to this aspect, the amount of advancement of the abutting member in the advanced state can be adjusted according to the number of the media stacked in the stacking portion.

For example, when the number of media stacked in the stacking portion is large, because the stiffness of the media bundle increases, it is possible to facilitate bending of the media by increasing the amount of advancement of the abutting member.

In a seventh aspect according to the first aspect to the sixth aspect, the folding roller pair transports and discharges the media folded by the folding roller pair.

According to this aspect, after the media have been folded at the folding position, a discharging configuration can be easily realized.

In an eighth aspect according to the first aspect to the seventh aspect, the media folding device further includes a binding unit for binding the media stacked in the stacking portion at a predetermined position in the transport direction, wherein a position at which binding is performed by the binding unit is set as the folding position.

According to this aspect, after the media stacked in the stacking portion are bound at a predetermined position in the transport direction, the media can be folded with the position at which binding is performed by the binding unit as the folding position.

In a ninth aspect according to the first aspect to the eighth aspect, the media folding device further includes a crease forming mechanism provided in the introduction path to form a crease in the media at the folding position.

According to this aspect, because a crease forming mechanism is provided in the introduction path to form a crease in the media at the folding position, the medium can be easily folded at the folding position.

In a tenth aspect according to the ninth aspect, the crease forming mechanism includes a crease forming portion that abuts against the media and that moves in a width direction intersecting the transport direction.

According to this aspect, a crease can be easily formed by the crease forming mechanism provided with the crease forming portion that abuts against the media and that moves in the width direction intersecting the transport direction.

A control method for a media folding device according to an eleventh aspect is a control method for a media folding device that includes a stacking portion on which media transported from an introduction path are placed; and a folding roller pair that folds the media at a folding position after the media have been stacked in the stacking portion, including: bending the media with a folding position at the top toward the folding roller pair by shortening a relative distance between a first abutting portion configured to abut against a front end of the media, which are stacked in the stacking portion, in a transport direction, and a second abutting portion that is configured to abut against a rear end of the media, which are stacked in the stacking portion, in the transport direction; nipping with the folding roller pair the folding position of the media that have been bent; and transporting the media by the folding roller pair.

According to this aspect, because the folding position of the media can be nipped by the folding roller pair by bending the media, it is possible to reduce the possibility of scratching the surface of the media when the folding position of the media is folded by the folding roller pair.

First Embodiment

Hereinafter, a first embodiment will be described with reference to the drawings. In the XYZ coordinate system illustrated in each drawing, the X-axis direction is the width direction of the medium and indicates the apparatus depth direction, the Y-axis direction indicates the apparatus width direction, and the Z-axis direction indicates the apparatus height direction.

Overview of Recording System

A recording system 1 illustrated in FIG. 1 includes, for example, a recording unit 2, an intermediate unit 3, and a processing unit 4 in order from right to left in FIG. 1.

The recording unit 2 includes a line head 10 as a "recorder" that performs recording on a medium P. The intermediate unit 3 receives the medium P after recording has been performed from the recording unit 2 and delivers it to the processing unit 4. The processing unit 4 includes a first processing portion 30 and a second processing portion 40, which will be described later, as processing devices for performing predetermined processing on the medium P after recording has been performed in the recording unit 2.

In the recording system 1, the recording unit 2, the intermediate unit 3, and the processing unit 4 are connected to one another so that the medium P can be transported from the recording unit 2 to the processing unit 4.

The recording system 1 is configured to enable input of, for example, an operation for recording on the medium P in the recording unit 2, the intermediate unit 3 and the processing unit 4 from an operation panel (not illustrated). The operation panel can, for example, be provided in the recording unit 2.

The schematic configurations of the recording unit 2, the intermediate unit 3 and the processing unit 4 will be described below in order.

Recording Unit

The recording unit 2 illustrated in FIG. 1 is configured as a multi-function machine including a printer unit 5 including the line head 10 (recorder) that ejects ink, which is a liquid, onto a medium to perform recording, and a scanner unit 6. In the present embodiment, the printer unit 5 is configured as a so-called ink jet printer that performs recording by ejecting ink, which is a liquid, from the line head 10 to a medium P.

At a lower portion of the recording unit 2, a plurality of medium housing cassettes 7 are provided. A medium housed in the medium housing cassettes 7 is fed to a recording region of the line head 10 through a feeding path 11 illustrated by a solid line in the recording unit 2 of FIG. 1, and a recording operation is performed thereon. The medium, after recording has been performed thereon by the line head 10, is sent to either of a first discharge path 12 for discharging the medium to a post-recording discharge tray 8 provided above the line head 10 or a second discharge path 13 for sending the medium to the intermediate unit 3. In the recording unit 2 of FIG. 1, the first discharge path 12 is indicated by a broken line, and the second discharge path 13 is indicated by a one-dot chain line.

In addition, the recording unit 2 includes an inverting path 14 indicated by a two-dot chain line in the recording unit 2 of FIG. 1, and after recording has been performed on a first side of the medium, the medium is inverted to enable recording to be performed on a second side.

In each of the feeding path 11, the first discharge path 12, the second discharge path 13, and the inverting path 14, a pair of transport roller pairs (not illustrated) is disposed as an example of a unit for transporting the medium.

The recording unit 2 is provided with a control unit 15 that controls operations related to the transport and recording of the medium in the recording unit 2.

Intermediate Unit

The intermediate unit 3 illustrated in FIG. 1 is disposed between the recording unit 2 and the processing unit 4, and is configured to receive a medium in a receiving path 20 after recording has been performed on the medium, the medium having been transferred from the second discharge path 13 of the recording unit 2, and to transport the medium to the processing unit 4. The receiving path 20 is indicated by a solid line in the intermediate unit 3 illustrated in FIG. 1.

In the intermediate unit 3, there are two transport paths along which the medium is transported. The first transport path is a path through which the medium is transported from the receiving path 20 to a merged path 23 via a first switchback path 21. The second path is a path through which the medium is transported from the receiving path 20 to the merged path 23 via a second switchback path 22.

The first switchback path 21 is a path that switches back the medium in the arrow A2 direction after receiving the medium in the arrow A1 direction. The second switchback path 22 is a path for switching back the medium in the arrow B2 direction after receiving the medium in the arrow B1 direction.

The receiving path 20 branches into the first switchback path 21 and the second switchback path 22 at a first branching portion 24. In addition, the first switchback path 21 and the second switchback path 22 merge at a merging portion 25. Therefore, regardless of which switchback path the medium is sent to from the receiving path 20, the medium can be transferred from the merged path 23, which is a common path, to the processing unit 4.

In the present embodiment, the merged path 23 branches into a first path 27 and a second path 28 at a second branching portion 26. The first path 27 is a path that sends the medium to the first processing portion 30 of the processing unit 4, and the second path 28 is a path that sends the medium to the second processing portion 40 of the processing unit 4. One or more transport roller pairs (not illustrated) are disposed in each of the receiving path 20, the first switchback path 21, the second switchback path 22, the merged path 23, the first path 27, and the second path 28.

In the case where recording is continuously performed on a plurality of media in the recording unit 2, the media having entered the intermediate unit 3 are alternately sent to the transport path passing through the first switchback path 21 and the transport path passing through the second switchback path 22. By this, it is possible to increase the medium transport throughput in the intermediate unit 3.

Further, in the recording system 1, the intermediate unit 3 can be omitted. That is, the recording unit 2 and the processing unit 4 can be connected to each other, and the medium, after recording has been performed thereon in the recording unit 2, can be directly sent to the processing unit 4 without passing through the intermediate unit 3.

As in the present embodiment, when the medium, after recording has been performed thereon in the recording unit 2, is sent to the processing unit 4 via the intermediate unit 3, because the transport time is longer than when the medium is directly sent from the recording unit 2 to the processing unit 4, it is possible to make the ink of the medium drier before being transported to the processing unit 4.

Processing Unit

As described above, the processing unit 4 illustrated in FIG. 1 includes two processing units, the first processing portion 30 and the second processing portion 40. In the first processing portion 30, as an example of predetermined processing performed on media, staple processing can be performed in which an end portion of the media is stapled by a stapler 36. As processing to be performed on media, it is also possible to adopt a configuration in which punch processing or the like is performed for forming holes in the media in addition to the staple processing.

In FIG. 1, media delivered from the first path 27 of the intermediate unit 3 to the first processing portion 30 are transported through a first transport path 31 by a first transport roller pair 32 and discharged into a first tray 35 by a discharge roller pair 33. The media are stacked on the first tray 35 with the rear end thereof aligned in the discharge direction. When a predetermined number of media are stacked on the first tray 35, the staple processing by the stapler 36 is performed on the rear end of the media. The stapled media are discharged to a second tray 37 by a discharging unit 38.

In addition, in the second processing portion 40, as processing to be performed on the media, it is possible to perform saddle-stitch processing in which a center portion of the media is bound and then the bound portion is folded to form a booklet. The second processing portion 40 is provided with a media folding device 50 that folds the media.

In FIG. 1, media delivered from the second path 28 of the intermediate unit 3 to the second processing portion 40 are transported by a second transport roller pair 42 through a second transport path 41, and are introduced into an introduction path 51 of the media folding device 50 by a third transport roller pair 43. Then, saddle stitch processing is performed in the media folding device 50. The media after being subjected to saddle stitch processing are discharged to a third tray 44.

The processing unit 4 includes a control unit 45 that controls various operations of the first processing portion 30 and the second processing portion 40, which includes the media folding device 50.

The media folding device 50 will be described in detail below.

Media Folding Device

Figure 2:
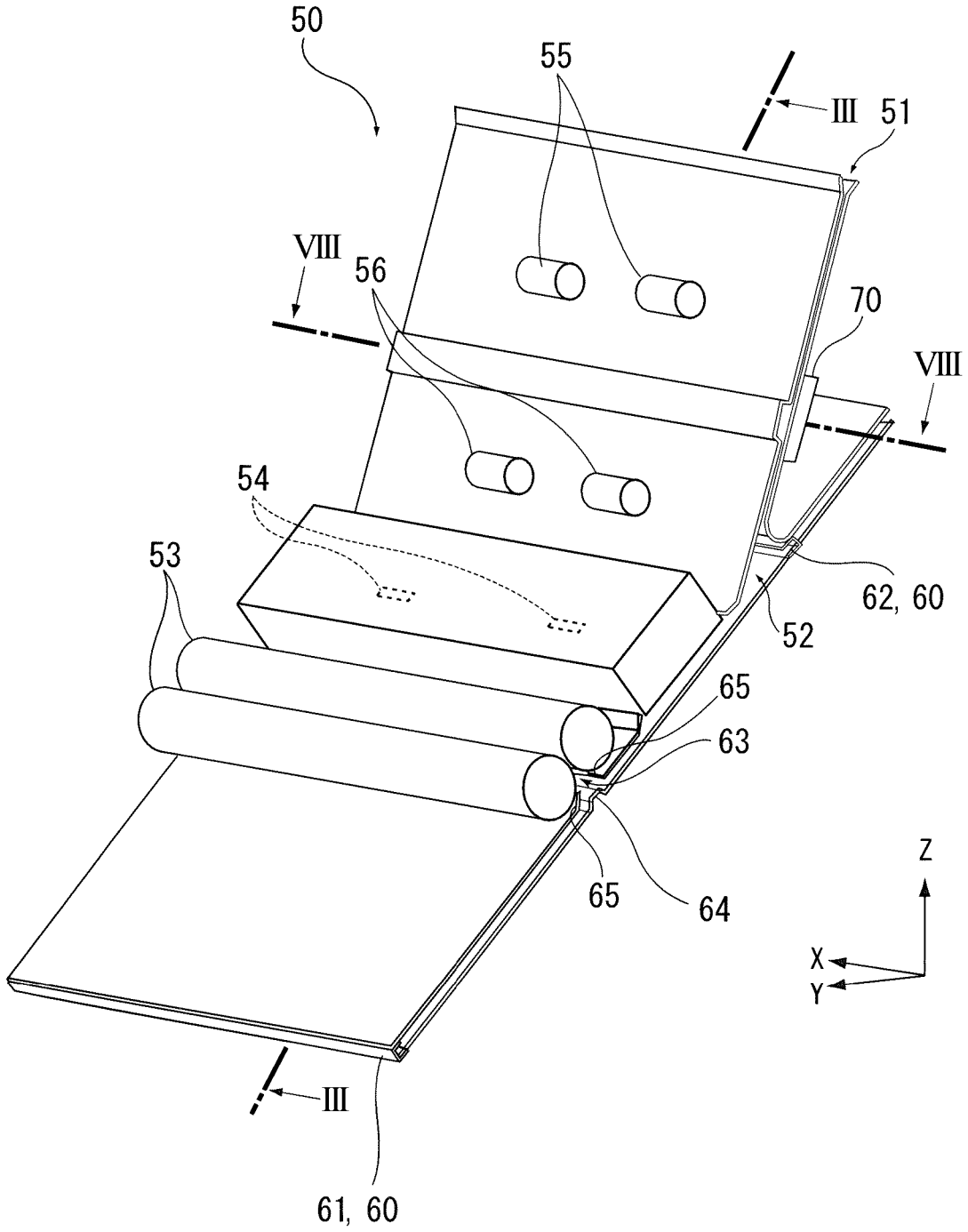
FIG. 2 is a perspective view illustrating a media folding device according to the first embodiment.
Figure 3:
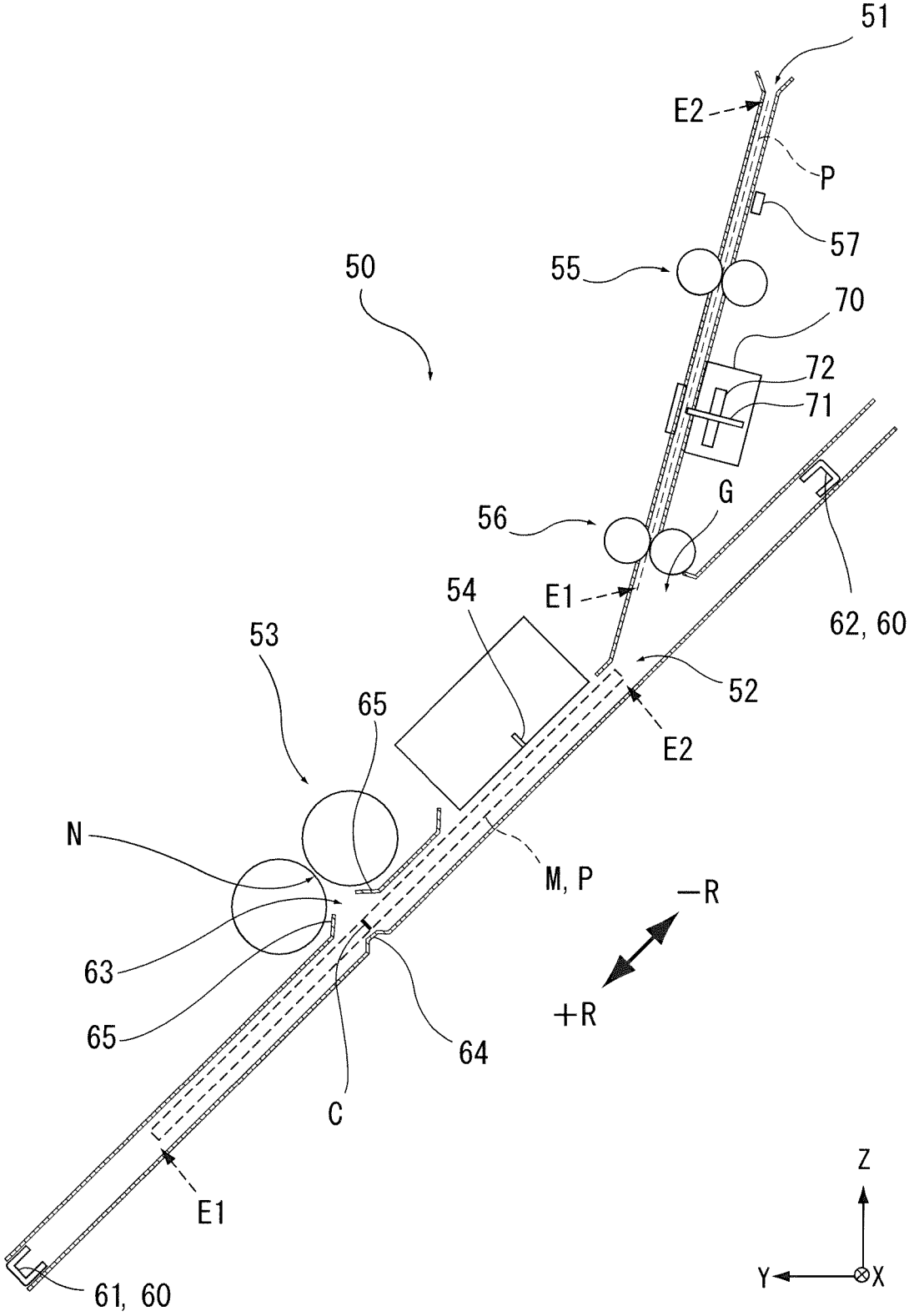
FIG. 3 is a cross-sectional view taken along the line III-III in FIG. 2.

The media folding device 50 illustrated in FIGS. 2 and 3 includes a stacking portion 52 on which media P (FIG. 3) transported from the introduction path 51 are placed, a folding roller pair 53 for folding the media P at a folding position C (FIG. 3) after the media P have been stacked in the stacking portion 52, and a bend forming mechanism 60 that causes the folding position C of the media P to be nipped by the folding roller pair 53. In FIG. 3, reference sign G indicates a joining position G where the introduction path 51 and the stacking portion 52 are joined to each other. In addition, a symbol M indicates a media bundle M in which a plurality of media P are stacked in the stacking portion 52 to form a bundle. In addition, the folding position C in the present embodiment is a center portion, in the transport direction +R, of the media P stacked in the stacking portion 52.

As illustrated in FIG. 3, the bend forming mechanism 60 includes a first abutting portion 61 capable of coming into contact with a front end E1, in the transport direction +R, of the media P stacked in the stacking portion 52 and a second abutting portion 62 capable of coming into contact with a rear end E2, in the transport direction +R, of the media P stacked in the stacking portion 52. The bend forming mechanism 60 is configured to cause the folding position C of the media to be nipped by the folding roller pair 53 by shortening the relative distance between the first abutting portion 61 and the second abutting portion 62 and bending the media P toward the folding roller pair 53.

Details of the operation of nipping the media P with the folding roller pair 53 by the bend forming mechanism 60 will be described later.

The first abutting portion 61 and the second abutting portion 62 are configured to move in both the transport direction +R of the media P in the stacking portion 52 illustrated in FIG. 3 and the reverse direction −R. In other words, the first abutting portion 61 and the second abutting portion 62 are configured to move in both directions toward and away from each other.

The first abutting portion 61 and the second abutting portion 62 can be moved in the transport direction +R and the reverse direction −R, for example, using a rack and pinion mechanism, a belt moving mechanism, or the like operated by the power of a drive source (not illustrated).

The media folding device 50 illustrated in FIGS. 2 and 3 includes, upstream of the folding roller pair 53, binding units 54 for binding the media bundle M stacked in the stacking portion 52 at predetermined positions in the transport direction +R. The binding units 54 are, for example, staplers. In the present embodiment, as illustrated in FIG. 2, a plurality of binding units 54 are provided at intervals in the width direction. Although provided in two places in FIG. 2, a configuration can be set such that three or more places are bound.

The binding units 54 are configured to bind at the center portion of the media bundle M, that is, at the folding position C in the transport direction +R. In other words, the binding positions for the binding units 54 correspond to the folding position C for the folding roller pair 53.

Therefore, after the media bundle M stacked in the stacking portion 52 is bound at the center portion in the transport direction +R, the booklet M can be formed with the binding positions for the binding unit 54 as the folding position C.

In addition, in the introduction path 51, an upstream roller pair 55 and a downstream roller pair 56 are provided, and a crease forming mechanism 70 that forms a crease at the folding position C of the medium P is provided between the upstream roller pair 55 and the downstream roller pair 56. By providing the crease forming mechanism 70 in the introduction path 51, it is possible to make creases at the folding positions C of the individual media P by the crease forming mechanism 70 before the folding process by the folding roller pair 53; therefore, the media bundle M can be easily folded at the folding position C.

Figure 8:
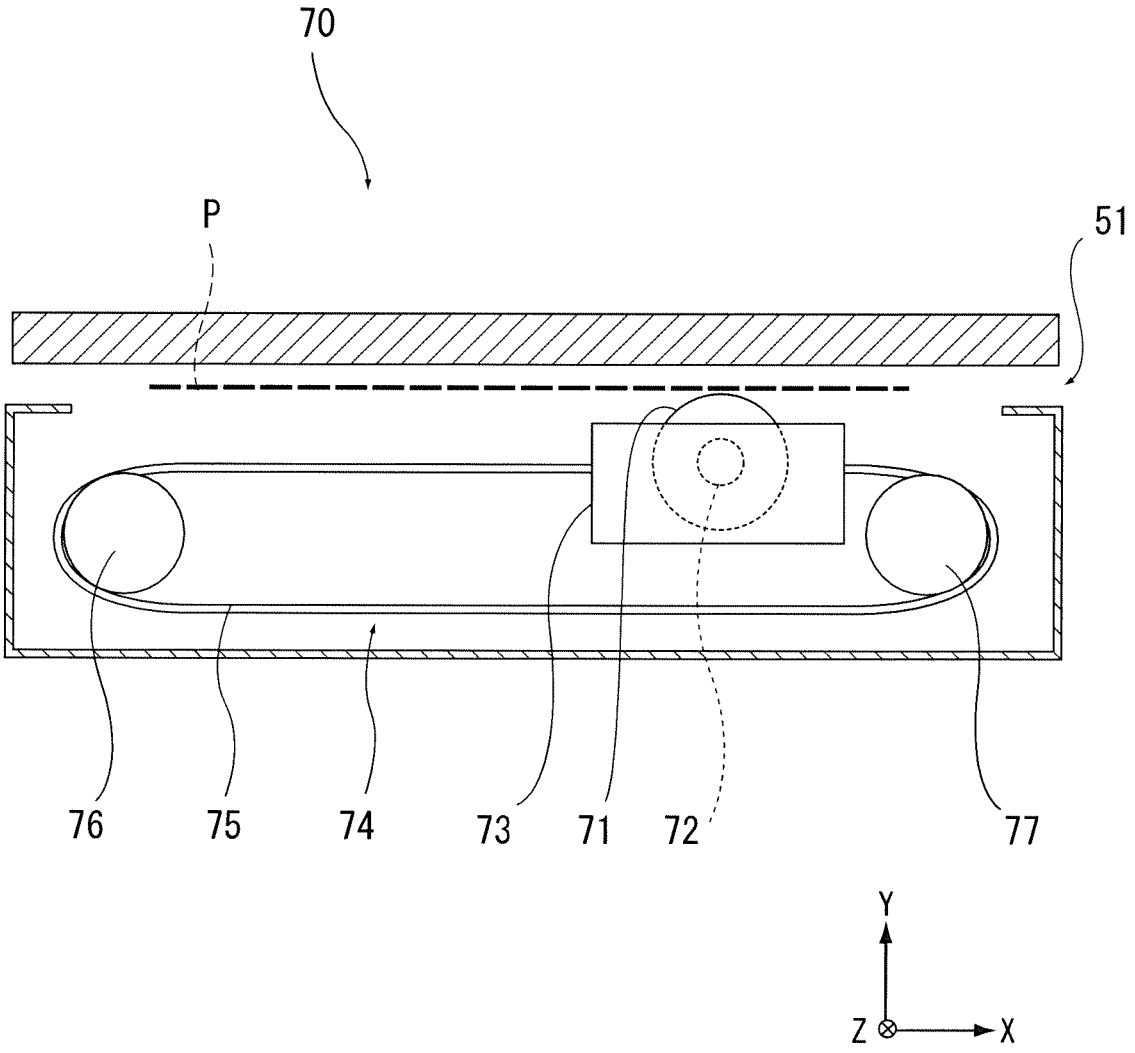
FIG. 8 is a cross-sectional view taken along line VIII-VIII in FIG. 2.

As illustrated in FIG. 8, the crease forming mechanism 70 includes a crease forming portion 71 that moves in the X axis direction in contact with the medium P. The X-axis direction is a width direction intersecting the transport direction +R of the media P stacked in the stacking portion 52 illustrated in FIG. 3. The crease forming portion 71 is formed as a rotating body that rotates about a rotation shaft 72. The crease forming portion 71 and the rotation shaft 72 are provided on a carriage 73, and the carriage 73 is attached to an endless belt 75 of a belt mechanism 74 as a moving mechanism that moves in the X-axis direction.

The belt mechanism 74 includes the endless belt 75, a drive pulley 76 around which the endless belt 75 is wound, and a driven pulley 77. The drive pulley 76 is rotationally driven by a drive source (not illustrated). The drive pulley 76 is rotatable clockwise and counterclockwise in a plan view of FIG. 8, and when rotated clockwise, the carriage 73 moves in the +X direction, and when rotated counterclockwise, the carriage 73 moves in the −X direction. In a state where the medium P is positioned above the crease forming portion 71, a crease can be easily formed by the lower surface of the crease forming portion 71 by moving the crease forming portion 71 in the X-axis direction while rotating the crease forming portion 71.

Next, with reference to FIGS. 4 to 7, the flow of the saddle stitch processing in the media folding device 50 will be described. The operation of the media folding device 50 is controlled by the control unit 45 (FIG. 1) as described above.

Figure 4:
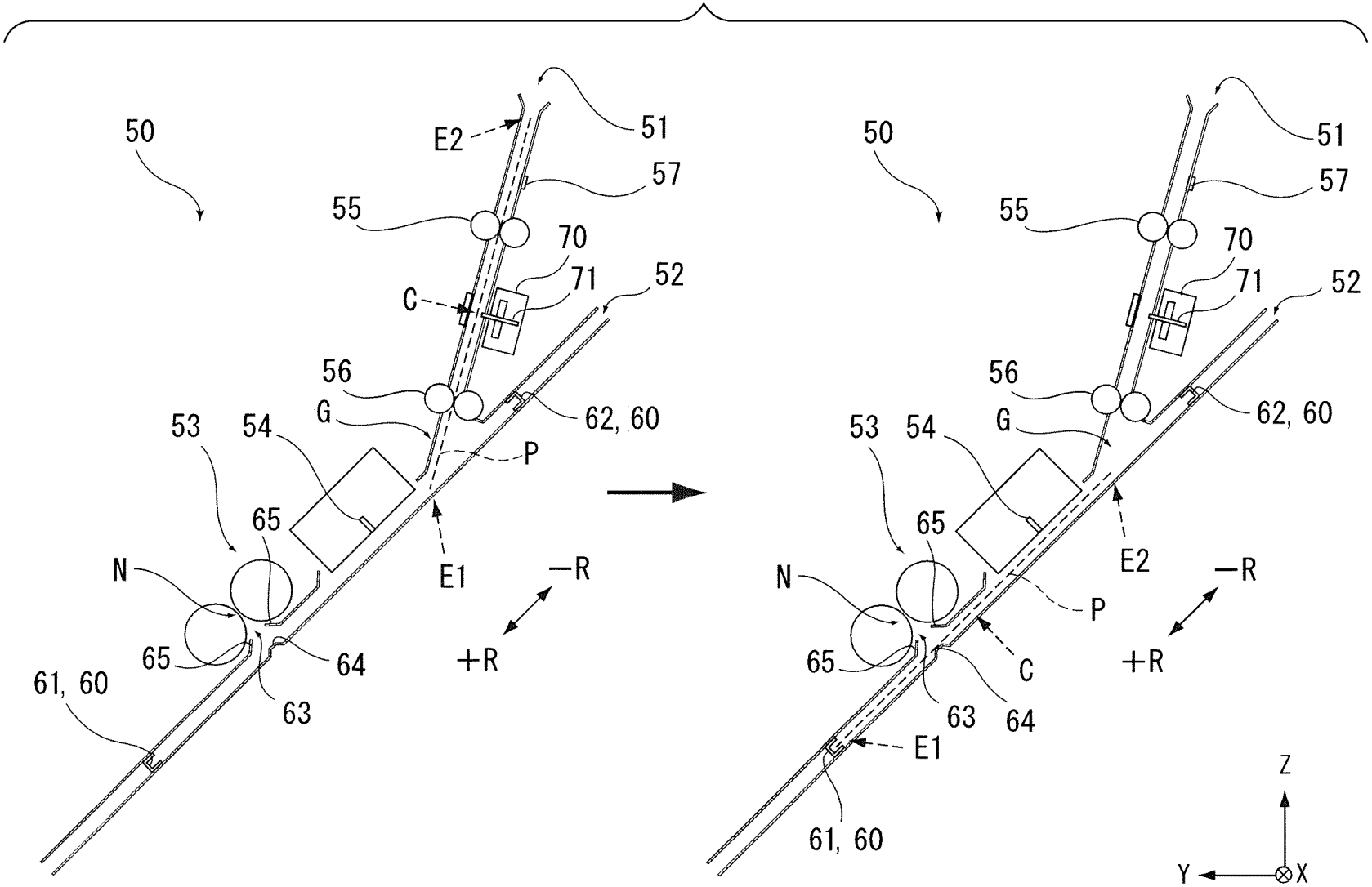
FIG. 4 is a diagram for explaining the flow of saddle stitch processing in the media folding device.

First, as illustrated in the left diagram of FIG. 4, the medium P is transported from the introduction path 51 toward the stacking portion 52. The medium P is transported in the introduction path 51 by the upstream roller pair 55 and the downstream roller pair 56. When the medium P is transported to a position corresponding to the crease forming portion 71 at the folding position C, which is the center portion of the medium P, the transport by the upstream roller pair 55 and the downstream roller pair 56 is stopped, and the folding position C is creased by moving the crease forming portion 71 in the X-axis direction which is the width direction of the medium P. When a crease is formed by the crease forming portion 71, the downstream roller pair 56 is stopped in a state where the medium P is tensioned so that the medium P is not bent between the upstream roller pair 55 and the downstream roller pair 56.

A medium detection unit 57 is provided upstream of the upstream roller pair 55. Using the detection of the front end E1 of the medium P by the medium detection unit 57 as a reference, by controlling the transport of the upstream roller pair 55 and the downstream roller pair 56, the folding position C of the medium P can be aligned with the position corresponding to the crease forming portion 71.

In the left view of FIG. 4, the first abutting portion 61 is disposed such that the distance from the joining position G of the introduction path 51 and the stacking portion 52 to the first abutting portion 61 is longer than the length of the medium P. As a result, as illustrated in the right view of FIG. 4, the medium P is received by the stacking portion 52 without the rear end E2 of the medium transported from the introduction path 51 remaining in the introduction path 51. The position of the first abutting portion 61 can be changed in accordance with the size of the medium P. The medium P transported to the stacking portion 52 collides with the first abutting portion 61 by its own weight.

A plurality of media P are stacked in the stacking portion 52 by repeating this operation. Subsequent media P are stacked on the previously stacked media P.

The second abutting portion 62 is located in the −R direction relative to the joining position G while the medium P is transported from the introduction path 51.

Figure 5:
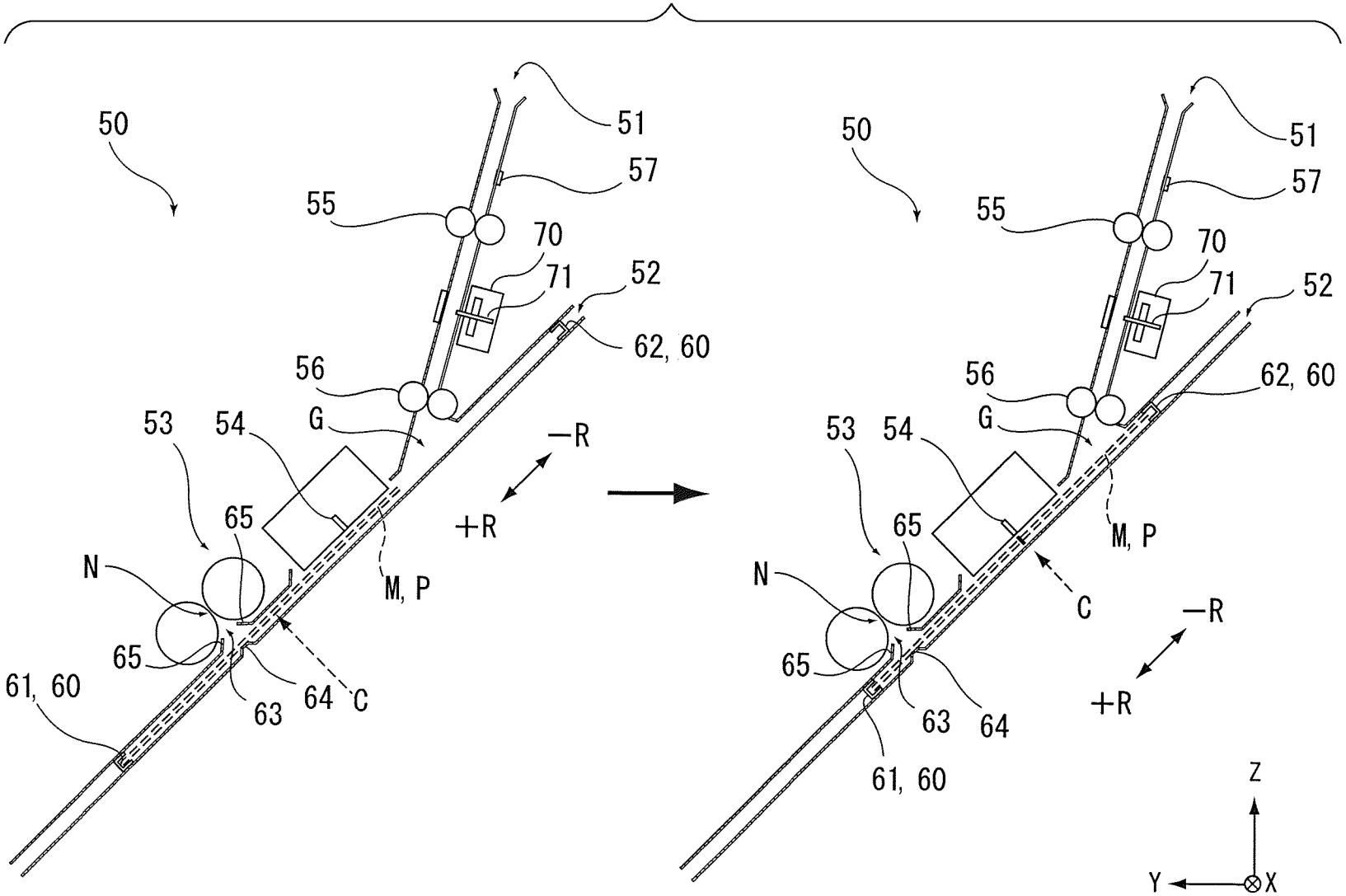
FIG. 5 is a diagram for explaining the flow of saddle stitch processing in the media folding device.

Subsequently, the left view of FIG. 5 illustrates a state in which a plurality of media P are stacked in the stacking portion 52. A bundle of media P is referred to as a media bundle M. When a predetermined number of media P are stacked in the stacking portion 52, the folding position C of the media bundle M is bound by the binding units 54. When transport of the medium P from the introduction path 51 to the stacking portion 52 is finished, the folding position C, as illustrated in the left diagram of FIG. 5, is located at a position deviated from the position of the binding units 54.

As illustrated in the right view of FIG. 5, the first abutting portion 61 is moved in the −R direction, and the folding position C of the media bundle M is disposed at a position facing the binding units 54. Furthermore, the second abutting portion 62 is moved in the +R direction to abut against the rear end E2 of the media bundle M. As a result, the front end E1 and the rear end E2 of the media bundle M can be aligned.

The media bundle M is stapled at the folding position C by the binding units 54 in a state where the front end E1 and the rear end E2 of the media bundle M are aligned.

Figure 6:
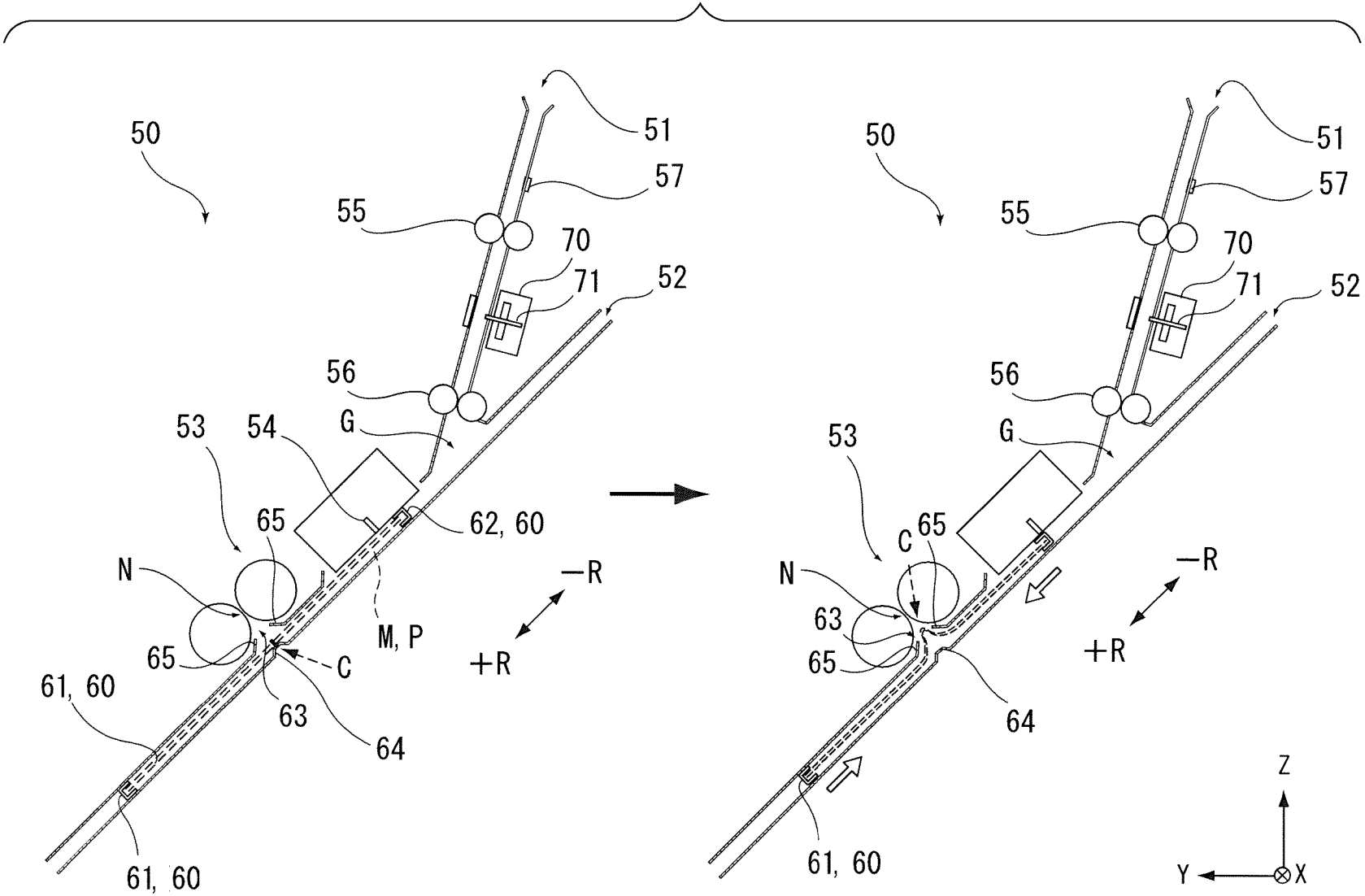
FIG. 6 is a diagram for explaining the flow of saddle stitch processing in the media folding device.

After the media bundle M has been bound by the binding units 54, as illustrated in the left diagram of FIG. 6, both the first abutting portion 61 and the second abutting portion 62 are moved in the +R direction and the media bundle M is moved such that the stapled folding position C is disposed at a position facing a nip position N of the folding roller pair 53.

Furthermore, the media bundle M may be moved in the +R direction by moving only the first abutting portion 61 in the +R direction while keeping the media bundle M in contact with the first abutting portion 61 by its own weight.

Figure 11:
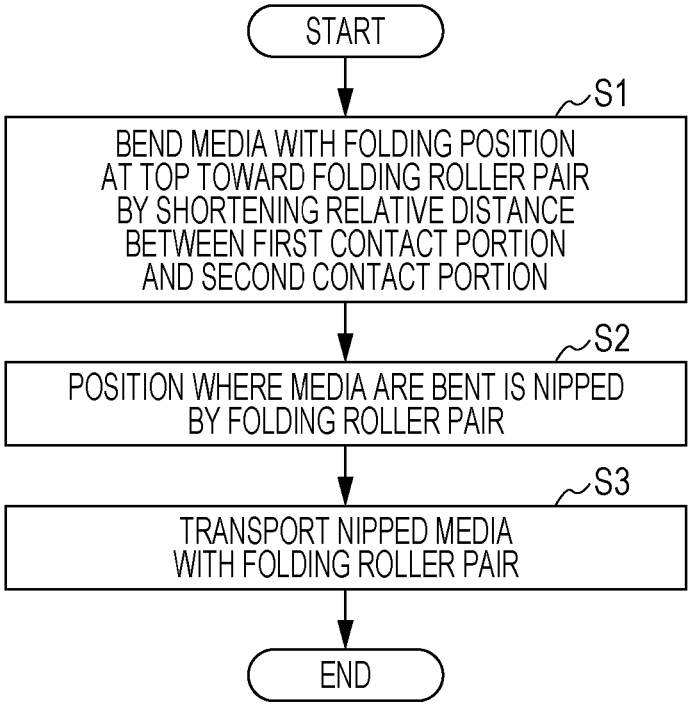
FIG. 11 is a flowchart illustrating a control method for the media folding device.

Subsequently, when the folding position C of the media bundle M is disposed at a position facing the nip position N of the folding roller pair 53, as illustrated in the right view of FIG. 6, the relative distance between the first abutting portion 61 and the second abutting portion 62 is shortened to bend the medium P toward the folding roller pair 53. That is, a first step S1 in the flowchart illustrated in FIG. 11 is performed.

The first abutting portion 61 and the second abutting portion 62 may both move to shorten the relative distance between the first abutting portion 61 and the second abutting portion 62 or, for example, the second abutting portion 62 may be brought close to the first abutting portion 61 while the first abutting portion 61 is fixed. Of course, the first abutting portion 61 can be moved while the second abutting portion 62 is fixed.

The stacking portion 52 is open between the folding position C illustrated in the left diagram of FIG. 6 and a nip position N of the folding roller pair 53, and an approach path 63 is formed. Guiding portions 65 formed as inclined surfaces that guide the folding position C to the nip position N from the stacking portion 52 are provided at the entrance of the approach path 63. When the relative distance between the first abutting portion 61 and the second abutting portion 62 is shortened, the center portion of the media bundle M is bent, and the folding position C passes through the approach path 63 and moves toward the nip position N of the folding roller pair 53.

Figure 7:
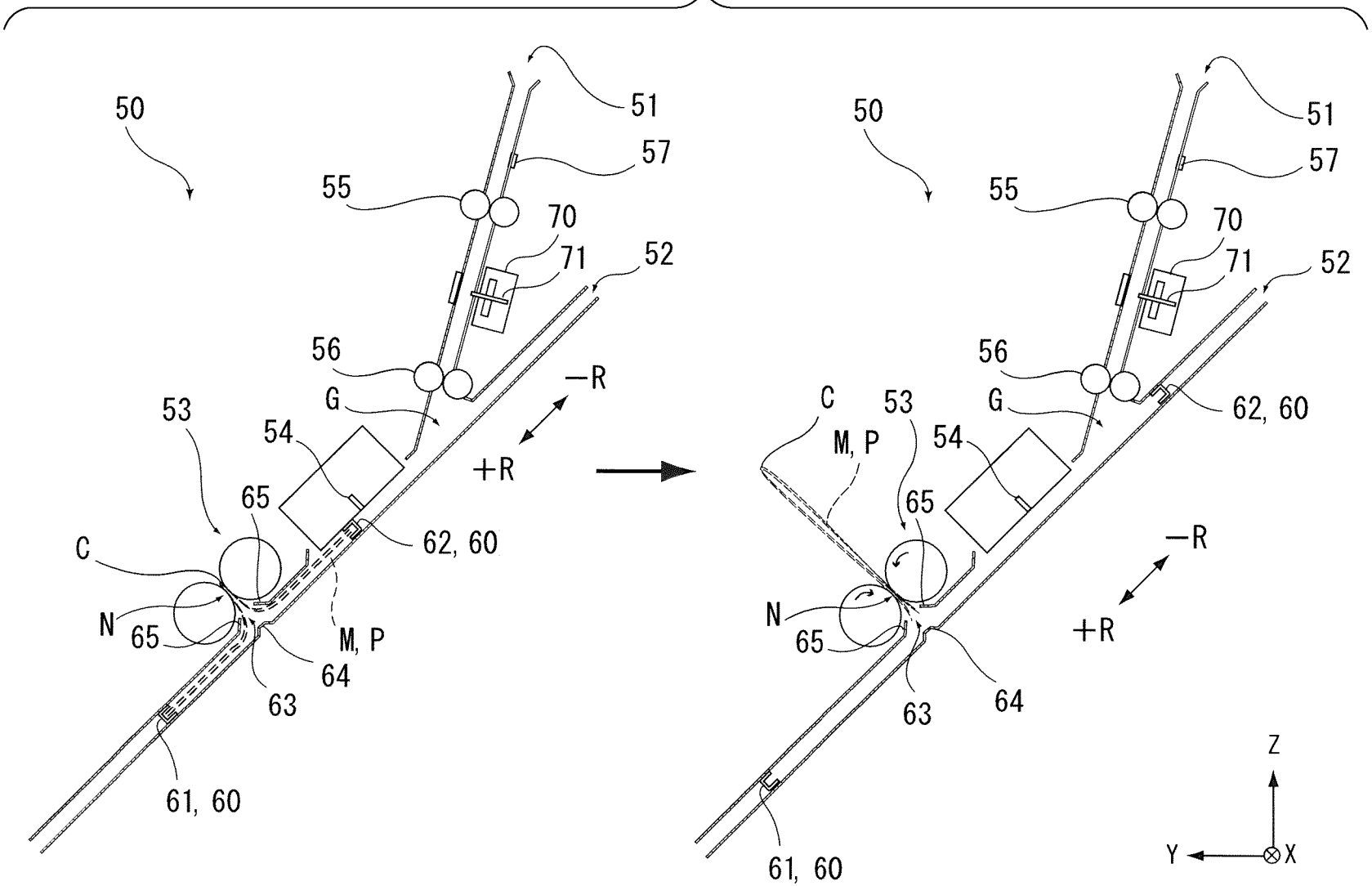
FIG. 7 is a diagram for explaining the flow of saddle stitch processing in the media folding device.

As illustrated in the left view of FIG. 7, when the first abutting portion 61 and the second abutting portion 62 are further brought close to each other, the folding position C is further moved toward the nip position N, and the folding position C of the bent media bundle M is nipped by the folding roller pair 53. That is, a second step S2 in the flowchart illustrated in FIG. 11 is executed.

When the folding position is nipped by the folding roller pair 53, the folding roller pair 53 rotate and transport the media bundle M. That is, a third step S3 in the flowchart illustrated in FIG. 11 is executed. Thus, the media bundle M is discharged toward the third tray 44 (FIG. 1) while being folded at the folding position C by the nip pressure of the folding roller pair 53.

In addition, after the folding position C is nipped by the folding roller pair 53, the first abutting portion 61 and the second abutting portion 62 move in directions away from each other, and return to the state of the left diagram in FIG. 4 in preparation for receiving the next medium P in the stacking portion 52.

As described above, the control method of the media folding device 50 includes, the first step S1 of bending the media bundle M toward the folding roller pair 53 with the folding position C at the top by shortening the relative distance between the first abutting portion 61 and the second abutting portion 62, the second step S2 of nipping the folded position C of the bent media bundle M by the folding roller pair 53, and the third step S3 of transporting the media bundle M by the folding roller pair 53.

In the present embodiment, since the relative distance is shortened between the first abutting portion 61 and the second abutting portion 62 as the bend forming mechanism 60, the medium P is bent toward the folding roller pair 53, and the folding position C of the medium P is nipped by the folding roller pair 53, it is possible to reduce the possibility of the surface of the medium P being scratched or wrinkled when folding the folding position C of the media bundle M by the folding roller pair 53.

In the stacking portion 52 illustrated in each of FIGS. 3 to 7, at a position corresponding to the folding position C at which the media bundle M is bent (for example, the left view in FIG. 6), that is, at a position opposite the approach path 63, no opening is provided, and a projecting portion 64 that protrudes toward the folding roller pair 53 side is provided.

That is, the stacking portion 52 is configured to allow the media bundle M (medium P) to bend in such a manner that the folding position C approaches the folding roller pair 53 and not allow the media to bend in such a manner that the folding position C moves away from the folding roller pair 53. Therefore, when the relative distance between the first abutting portion 61 and the second abutting portion 62 is shortened, the media bundle M can be bent in a direction in which the folding position C approaches the folding roller pair 53, and the folding position C can be nipped by the folding roller pair 53 more reliably.

In addition, because the stacking portion includes the projecting portion 64, when the first abutting portion 61 and the second abutting portion 62 are brought close to each other, the folding position C of the media bundle M can be easily bent so as to be directed toward the folding roller pair 53 side.

Second Embodiment

In a second embodiment, another example of the medium folding apparatus will be described with reference to FIG. 9.

Further, in the second and subsequent embodiments, the same components as those in the first embodiment are denoted by the same reference signs as in the first embodiment, and description thereof will be omitted.

Figure 9:
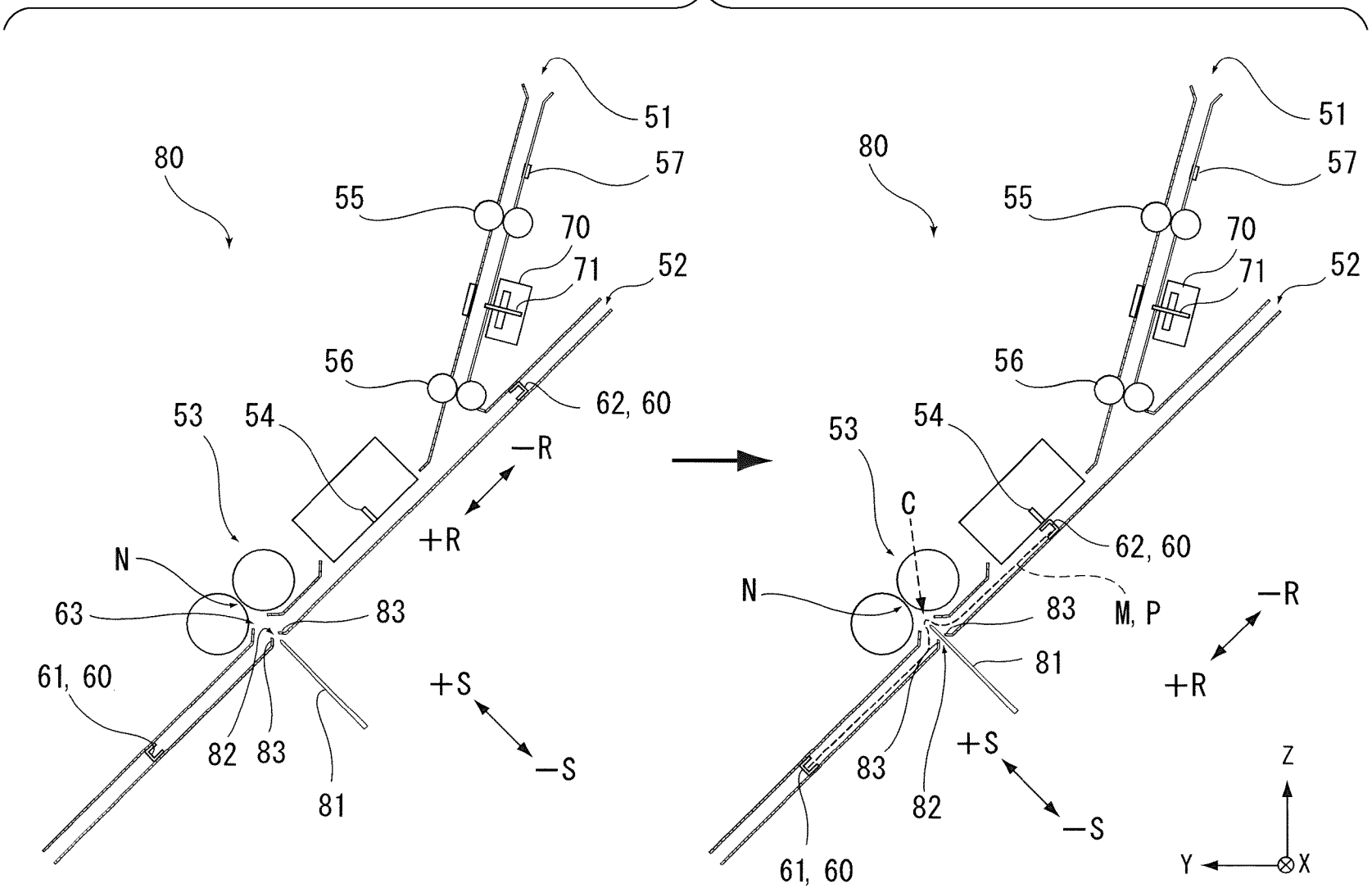
FIG. 9 is a view for explaining a media folding device according to a second embodiment.

A media folding device 80 illustrated in the second embodiment includes an abutting member 81 that is provided at a position on the opposite side to the folding roller pair 53 with respect to the stacking portion 52 and that is capable of switching between, as illustrated in the left diagram of FIG. 9, a retracted state of being retracted from the stacking portion 52, and as illustrated in the right diagram of FIG. 9, an advanced state of being advanced with respect to the folding position C of the media P stacked in the stacking portion 52.

In the left and right diagrams of FIG. 9, the +S direction is the advancing direction of the abutting member 81, and the −S direction is the retracting direction of the abutting member 81.

In the left view of FIG. 9, projecting portions 83 that includes a hole portion 82 at the top and that protrude toward the folding roller pair 53 are provided at positions facing the approach path 63.

The abutting member 81 is entirely provided outside the stacking portion 52 in the retracted state illustrated in the left diagram of FIG. 9. In addition, the front end of the abutting member 81 advances from the hole portion 82 into the stacking portion 52, and ends up in the state illustrated in the right diagram of FIG. 9.

When the media bundle M is bent by shortening the relative distance between the first abutting portion 61 and the second abutting portion 62, by providing the abutting member 81 that advances and retracts with respect to the stacking portion 52, it is possible to assist in bending the folding position C toward the folding roller pair 53 side with the abutting member 81 in the advanced state.

Here, the abutting member 81 in the advanced state illustrated in the right view of FIG. 9 does not overlap the folding roller pair 53 in the advancing direction +S.

When the abutting member 81 advances to a position overlapping the folding roller pair 53 in the advancing direction +S and approaches the nip position N, after the folding position C of the media bundle M is nipped by the folding roller pair 53, the abutting member 81 can easily contact the inner surface of the folded media bundle M, and when the abutting member 81 is returned from the advanced state to the retracted state, the inner side surface of the media bundle M may be scratched.

In this embodiment, since the abutting member 81 in the advanced state does not overlap the folding roller pair 53 in the advancing direction +S, the likelihood of the inner side surface of the media bundle M being scratched when the abutting member 81 returns from the advanced state to the retracted state can be reduced.

Further, it is desirable that the abutting member 81 in the advanced state not overlap the folding roller pair 53 in the advancing direction +S; however, the abutting member 81 in the advanced state may be configured to overlap the folding roller pair 53 in front of the nip position N at a position where it is not nipped by the folding roller pair 53.

In addition, the abutting member 81 may be configured to adjust the amount of advancement in the advanced state. Thus, the amount of advancement of the abutting member 81 in the advanced state can be adjusted in accordance with the number of media P stacked in the stacking portion 52. For example, when the number of media P stacked in the stacking portion 52 is large, the rigidity of the entire media bundle M may be high, and it may be difficult to form a bend by the bend forming mechanism 60. Therefore, when the number of stacked media P is large, by increasing the amount of advancement of the abutting member 81 in the advanced state, it is possible to facilitate the formation of the bend by the bend forming mechanism 60.

In addition, when the rigidity of the medium P itself is high, the amount of advancement of the abutting member 81 can be increased even if the number of media stacked is small.

Third Embodiment

In a third embodiment, another example of the medium folding apparatus will be described with reference to FIG. 10.

In a medium folding apparatus 90 illustrated in the third embodiment, the stacking portion 52 is formed by connecting an upstream member 91 formed upstream in the transport direction +R and a downstream member 92 formed downstream of the upstream member 91. The upstream member 91 and the downstream member 92 are connected by a connection portion 93.

Figure 10:
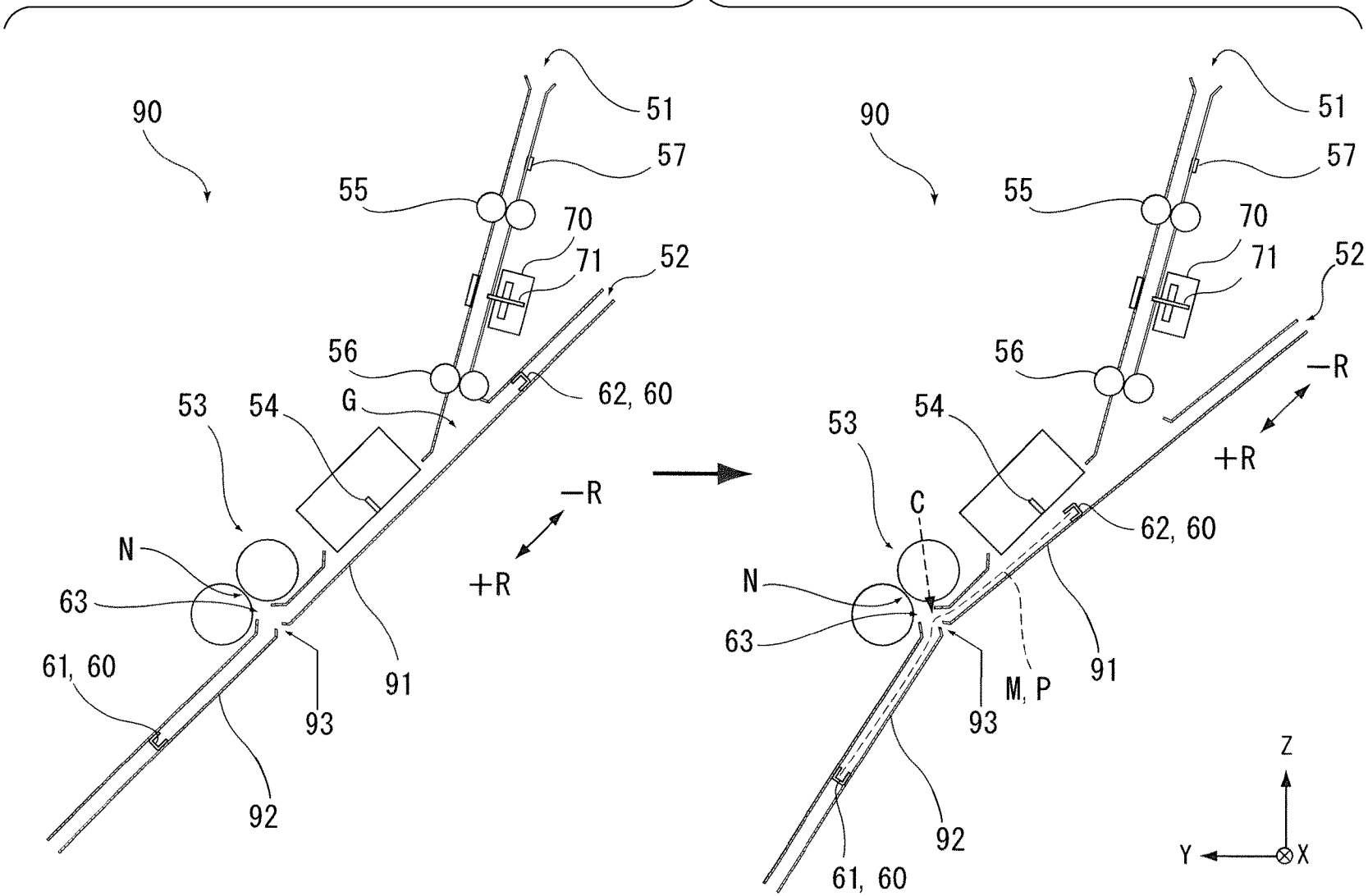
FIG. 10 is a view for explaining a media folding device according to a third embodiment.

As illustrated in the left diagram of FIG. 10, the stacking portion 52 is configured to switch between a linear state in which the upstream member 91 and the downstream member 92 are flush, and as illustrated in the right diagram of FIG. 10, a bent state in which the upstream member 91 and the downstream member 92 are connected so to form a projecting shape toward the folding roller pair 53, and the connection portion 93 is provided at a position corresponding to the folding position C of the medium P, as illustrated in the right diagram of FIG. 10.

Because the upstream member 91 and the downstream member 92 constituting the stacking portion 52 can be switched between the linear state illustrated in the left diagram of FIG. 10 and the bent state in which they form a projecting shape with the connection portion 93, which is provided at a position corresponding to the folding position C of the medium P, as the top as illustrated in the right diagram of FIG. 10, when bending the media bundle M by using the bend forming mechanism 60, the bend at the folding position C of the media bundle M toward the folding roller pair 53 can be easily formed by bending the upstream member 91 and the downstream member 92. When stacking media P from the introduction path 51 to the stacking portion 52 or when binding the media bundle M by using the binding unit 54, by setting the upstream member 91 and the downstream member 92 in a linear state, it is possible to realize appropriate stacking and binding processing of media.

The processing unit 4 in the first embodiment can be regarded as a "media folding device" including the stacking portion 52, the folding roller pair 53, and the bend forming mechanism 60. In addition, the apparatus from which the recording function is omitted from the recording system 1 can be regarded as a "media folding device" including the stacking portion 52, the folding roller pair 53, and the bend forming mechanism 60.

In addition, it is needless to say that various modifications are possible within the scope of the disclosure described in the claims without being limited to the above embodiment, and they are also included in the scope of the present disclosure.

What is claimed is:

1. A media folding device comprising:

a stacking portion on which media transported from an introduction path are placed;

a folding roller pair that folds the media at a folding position after the media have been stacked in the stacking portion;

a bend forming mechanism that includes a first abutting portion configured to abut against a front end of the media, which are stacked in the stacking portion, in a transport direction, and a second abutting portion that is configured to abut against a rear end of the media, which are stacked in the stacking portion, in the transport direction, and that causes a folding position of the media to be nipped by the folding roller pair by shortening the relative distance between the first abutting portion and the second abutting portion to bend the media toward the folding roller pair; and a binding unit for binding the media stacked in the stacking portion at a predetermined position in the transport direction, wherein the first abutting portion and the second abutting portion align the front end of the media and the rear end of the media, the first abutting portion moves to dispose the folding position of the media at a position facing the binding unit, and the stacking portion is formed by connecting an upstream member formed upstream in the transport direction and a downstream member formed downstream of the upstream member, and a connection portion between the upstream member and the downstream member is provided at a position corresponding to the folding position when the medium is bent and is configured to switch between a linear state in which the upstream member and the downstream member are flush and a bent state in which the upstream member and the downstream member are connected in a projecting shape toward the folding roller pair side.

2. The media folding device according to claim 1, wherein the stacking portion includes a projecting portion that protrudes toward the folding roller pair at a position corresponding to the folding position when the media are bent.

3. A control method for a media folding device that includes a stacking portion on which media transported from an introduction path are placed, wherein the stacking portion is formed by connecting an upstream member formed upstream in a transport direction and a downstream member formed downstream of the upstream member, and a connection portion between the upstream member and the downstream member is provided at a position corresponding to the folding position when the media are bent and; a folding roller pair that folds the media at a folding position after the media have been stacked in the stacking portion, comprising:

aligning the front end of the media and the rear end of the media by a first abutting portion configured to abut against a front end of the media, which are stacked in the stacking portion, in the transport direction, and a second abutting portion that is configured to abut against a rear end of the media, bending the media with a folding position at the top toward the folding roller pair by shortening a relative distance between a first abutting portion configured to abut against a front end of the media, which are stacked in the stacking portion, in a transport direction, and a second abutting portion that is configured to abut against a rear end of the media, which are stacked in the stacking portion, in the transport direction;

nipping with the folding roller pair the folding position of the media that have been bent;

transporting the media by the folding roller pair; and switching between a linear state in which the upstream member and the downstream member are flush and a bent state in which the upstream member and the downstream member are connected in a projecting shape toward the folding roller pair side.

4. The media folding device according to claim 3, further comprising:

a binding unit for binding the media stacked in the stacking portion at a predetermined position in the transport direction, wherein the first abutting portion moves to dispose the folding position of the media at a position facing the binding unit.

5. The media folding device according to claim 4, wherein the first abutting portion moves to dispose the folding position of the media bound by the binding unit at a position facing a nip position of the folding roller pair.

6. A media folding device comprising:

a stacking portion on which media transported from an introduction path are placed;

a folding roller pair that folds the media at a folding position after the media have been stacked in the stacking portion; and a bend forming mechanism that includes a first abutting portion configured to abut against a front end of the media, which are stacked in the stacking portion, in a transport direction, and a second abutting portion that is configured to abut against a rear end of the media, which are stacked in the stacking portion, in the transport direction, and that causes a folding position of the media to be nipped by the folding roller pair by shortening the relative distance between the first abutting portion and the second abutting portion to bend the media toward the folding roller pair, wherein the first abutting portion and the second abutting portion align the front end of the media and the rear end of the media, and wherein the stacking portion includes a projecting portion that protrudes toward the folding roller pair at a position corresponding to the folding position when the media are bent.

7. The media folding device according to claim 6, wherein the stacking portion is formed by connecting an upstream member formed upstream in the transport direction and a downstream member formed downstream of the upstream member, and a connection portion between the upstream member and the downstream member is provided at a position corresponding to the folding position when the medium is bent and is configured to switch between a linear state in which the upstream member and the downstream member are flush and a bent state in which the upstream member and the downstream member are connected in a projecting shape toward the folding roller pair side.

8. The media folding device according to claim 6 further comprising:

an abutting member that is provided at a position on the opposite side to the folding roller pair with respect to the stacking portion, and that is configured to switch between a retracted state of being retracted from the stacking portion, and an advanced state of being advanced to the folding position of the media stacked in the stacking portion, wherein the abutting member in the advanced state does not overlap a nip position of the folding roller pair in the advancing direction.

9. The media folding device according to claim 8, wherein the abutting member is configured to adjust an amount of advancement in the advancing state in accordance with the rigidity of the media stacked in the stacking portion.

10. The media folding device according to claim 6, wherein the folding roller pair transports and discharges the media folded by the folding roller pair.

11. The media folding device according to claim 6, further comprising:

a crease forming mechanism provided in the introduction path to form a crease in the media at the folding position.

* * * * *